US006874572B2

(12) United States Patent
Wanni et al.

(10) Patent No.: US 6,874,572 B2
(45) Date of Patent: Apr. 5, 2005

(54) HEAT EXCHANGER FLOW-THROUGH TUBE SUPPORTS

(75) Inventors: Amar S. Wanni, Falls Church, VA (US); Marciano M. Calanog, Gainesville, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/209,126

(22) Filed: Jul. 31, 2002

(65) Prior Publication Data

US 2003/0178187 A1 Sep. 25, 2003

Related U.S. Application Data

(60) Provisional application No. 60/366,914, filed on Mar. 22, 2002.

(51) Int. Cl.[7] ..... F28F 1/38; F28F 1/34; F28F 9/013

(52) U.S. Cl. ..... 165/172; 165/162

(58) Field of Search ..... 165/162, 172

(56) References Cited

U.S. PATENT DOCUMENTS

| | | | | |
|---|---|---|---|---|
| 1,777,356 A | | 10/1930 | Fisher | |
| 1,946,234 A | | 2/1934 | Price | |
| 2,749,600 A | * | 6/1956 | Persson | 165/172 |
| 2,774,575 A | | 12/1956 | Walter | |
| 3,249,154 A | * | 5/1966 | Legrand | 165/184 |
| 3,326,282 A | | 6/1967 | Jenssen | |
| 3,603,383 A | | 9/1971 | Michael | |
| 4,398,567 A | * | 8/1983 | Moll | 138/113 |
| 4,428,403 A | * | 1/1984 | Lee et al. | 165/184 |
| 4,450,904 A | * | 5/1984 | Volz | 165/162 |

FOREIGN PATENT DOCUMENTS

| | | |
|---|---|---|
| JP | 58184498 | 10/1983 |
| WO | WO 00/65286 | 11/2000 |

* cited by examiner

*Primary Examiner*—Leonard R. Leo
(74) *Attorney, Agent, or Firm*—Malcolm D Kean; Jack B. Murray

(57) ABSTRACT

The present invention comprises a novel tube support system for a heat exchanger that serves to replace the baffles present in typical shell-and-tube heat exchangers. The shell-and-tube heat exchanger of the present invention employs helically coiled wires to form a support structure for the tubes contained within the heat exchanger shell. The elimination of baffles and the use of the coil support structure according to the present invention permits axial fluid flow for the shell side fluid and significantly minimizes fouling problems and tube damage resulting from flow-induced tube vibration.

9 Claims, 6 Drawing Sheets

HEAT EXCHANGER FLOW-THROUGH TUBE SUPPORTS

RELATED APPLICATION

This patent application claims priority to Provisional Application Ser. No. 60/366,914, filed on Mar. 22, 2002.

BACKGROUND

1. Field of the Invention

The present invention relates generally to heat exchangers and more particularly to support structures for heat exchanger tubes within heat exchanger devices.

2. Background of the Invention

Although heat exchangers were developed many decades ago, they continue to be extremely useful in many applications requiring heat transfer. While many improvements to the basic design available in the twentieth century have been made, there still exist tradeoffs and design problems associated with the inclusion of heat exchangers within commercial processes.

In particular, one of the most problematic aspects associated with the use of heat exchangers is the tendency toward fouling. Fouling refers to the various deposits and coatings which form on the surfaces of heat exchangers as a result of process fluid flow and heat transfer. There are various types of fouling including corrosion, mineral deposits, polymerization, crystallization, coking, sedimentation and biological. In the case of corrosion, the surfaces of the heat exchanger can become corroded as a result of the interaction between the process fluids and the materials used in the construction of the heat exchanger. The situation is made even worse due to the fact that various fouling types can interact with each other to cause even more fouling. Fouling can and does result in additional resistance with respect to the heat transfer and thus decreased performance with respect to heat transfer. Fouling also causes an increased pressure drop in connection with the fluid flowing on the inside of the exchanger.

Many heat exchangers in use today also contain baffles. Baffles are interposed in the fluid path in order to ensure that the fluid flowing on the outside the tubes flows across the tubes. Unfortunately, however, baffles serve to increase the fouling problem because they create dead zones on the shell side of the exchanger.

One type of heat exchanger which is commonly used in connection with commercial processes is the shell-and-tube exchanger. In this format, the device is designed such that one fluid flows on the inside of the tubes, while the other fluid is forced through the shell and over the outside of the tubes. Typically, baffles are placed to support the tubes and to force the fluid across the tube bundle in a serpentine fashion.

Fouling can be decreased through the use of higher fluid velocities. In fact, one study has shown that a reduction in fouling in excess of 50% can result from a doubling of fluid velocity. It is known that the use of higher fluid velocities can substantially decrease or even eliminate the fouling problem. Unfortunately, higher fluid velocities are generally unattainable on the shell side of conventional shell-and-tube heat exchangers because of excessive pressure drops which are created within the system because of the baffles.

Another problem that often arises in connection with the use of heat exchangers is tube vibration damage. Tube vibration is most intense and damage is most likely to occur in cross flow implementations where fluids flow is perpendicular to the tubes, although tube vibration damage can also occur in non-crossflow (i.e. axial) implementations in the case of very high fluid velocities.

Existing shell-and-tube heat exchangers suffer from the fact that they must typically use baffles to maintain the required heat transfer. This, however, results in "dead zones" within the heat exchanger where flow is minimal or even non-existent. These dead zones generally lead to excessive fouling. Other types of heat exchangers may or may not employ baffles. If they do, the same increased fouling problem exists. Further, in heat exchangers fitted with baffles, for example, the cross flow implementation results in the additional problem of potential damage to tubes as a result of flow-induced vibration. In the case of such damage, processes must often be interrupted or shut down in order to perform costly and time consuming repairs to the device.

SUMMARY OF THE INVENTION

According to a representative embodiment, the present invention comprises a novel tube support system that serves to replace the baffles present in typical shell-and-tube heat exchangers. The shell-and-tube heat exchanger of the present invention employs helically coiled wires to form a support structure for the tubes contained within the heat exchanger shell.

In one embodiment of the present invention, the wire coil has a diameter substantially equal to the space between the heat exchanger tubes.

In another embodiment, the wire coil has a diameter equal to one-half of the space between the tubes.

In a preferred embodiment of the present invention, the coils in the support structure alternate between a clockwise and a counterclockwise rotation within the support structure.

In one embodiment of the present invention, the coils forming the support structure overlap with one another while in an alternative embodiment, the coils make point contact with another.

In a preferred embodiment of the present invention, high velocity axial flow is used in order to eliminate dead zones and related fouling problems.

As will be recognized by one of skill in the art, and as will be explained in further detail below, the present invention provides many advantages including a significant reduction of flow-induced tube vibration that can lead to tube damage, thermal expansion problems and dead zones that promote rapid fouling. Furthermore, the present invention provides axial flow on the shell side thereby eliminating the presence of dead zones which cause fouling and which are typically contained within prior art heat exchangers.

Additionally, the heat exchanger design according to the present invention permits operation at high fluid velocities on the shell side of the exchanger in order to substantially reduce fouling. Velocities are essentially only limited by erosion limits and pump size. The use of the tube support system of the present invention also makes it easier to predict the performance of the heat exchanger as the flow geometry is simple and has no bypass or leakage streams. As a result, simpler calculations may be used in order to design exchangers using the teachings of the present invention.

The above and other objects of the present invention are achieved through the use of a tube support system which supports the tubes in a novel way and in a way in which baffles are not required to obtain the necessary heat transfer characteristics.

DETAILED DESCRIPTION OF THE PREFERRED EMBODIMENTS

Figure 1:
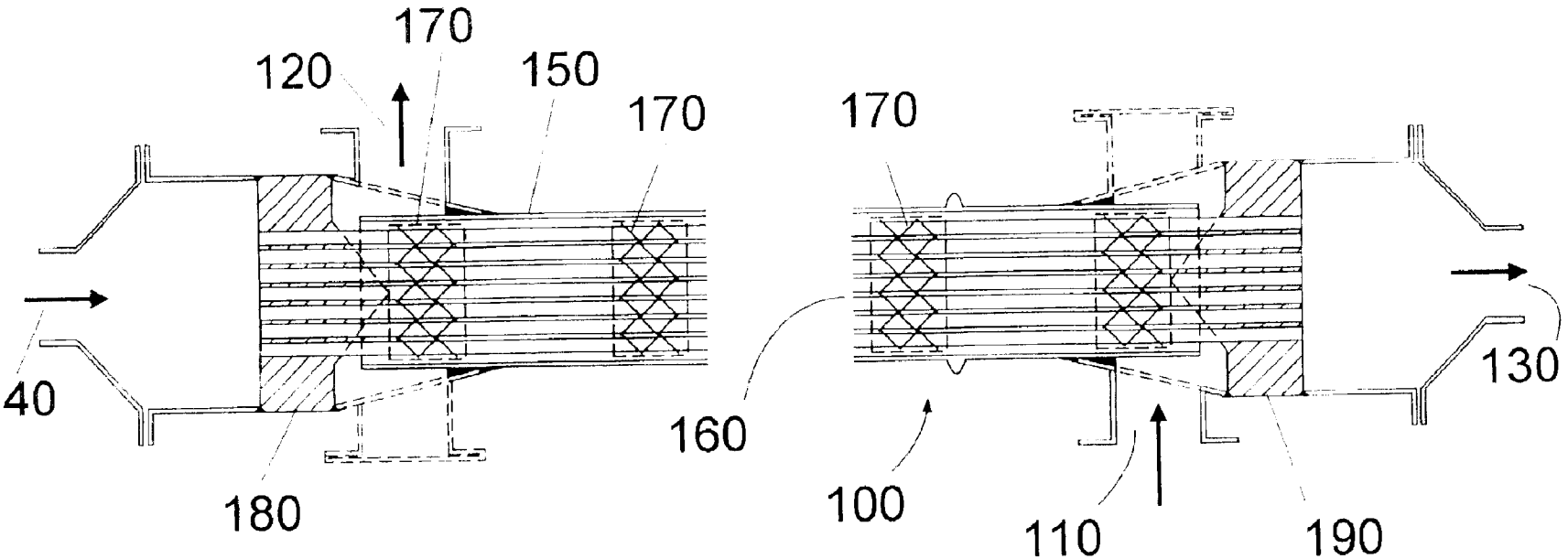
FIG. 1 is a side elevation view of a single-pass heat exchanger as constructed according to the teachings of the present invention.

FIG. 1 illustrates a heat exchanger constructed according to the teachings of the present invention. In the figure, the shell portion is broken away to more clearly illustrate the tube bundle construction. While FIG. 1 shows a shell-and-tube exchanger in the form of a single-pass embodiment, the teachings of the present invention are equally applicable to many other forms of shell-and-tube exchangers such as, for example, two or more tube passes, U-shaped tubes, removable tube bundle designs, and exchangers known as multi-tube double pipes. The heat exchanger 100 of the present invention includes a shell 150 and a tube bundle 160 contained therein.

In a preferred embodiment, tube bundle 160 includes a pair of tubesheets 180 and 190 located respectively at each end of the tube bundle 160. The tubes contained in tube bundle 160 are fastened to apertures contained within tubesheets 180 and 190 by means known in the art such as by welding and/or by expanding the tubes into tubesheets 180 and 190. Tube side inlet 140 and corresponding tube side outlet 130 provide a means for introducing a first fluid into the tubes in tube bundle 160, and for expelling the first fluid from exchanger 100, respectively. Shell side inlet 110 and shell side outlet 120 provide a means for a second fluid to enter and exit the shell side of heat exchanger 100, respectively, and thus pass over the outside of the tubes comprising tube bundle 160.

The novel coils 170 of the present invention are shown in FIG. 1. As will be discussed in greater detail below, coils 170 contain tubes within their internal periphery and also serve to provide a support structure to allow tubes to be inserted between the outside peripheries of the coils 170. According to the teachings of the present invention, coils 170 may extend fully from tubesheet 180 all the way to tubesheet 190, or alternatively, one or more coil structures may be intermittently spaced along the tubes. For example, a coil structure may begin twelve inches from tubesheet 180 and then extend approximately eight inches. This could be followed by a gap of approximately two feet followed by another length of coil structure and so on. However, it is possible for the coil structure to extend the full length of the tubes without gaps. The support structures of the present invention may be preferably welded to tie rods or, in the alternative or in addition, to several tubes at the outer periphery of tube bundle 160 in order to prevent the support structure from moving.

In a preferred embodiment of the present invention, axial flow is used for the shell side fluid. In addition it is also preferable that a countercurrent flow arrangement be employed as between the two different fluids although a non-countercurrent (i.e. cocurrent) flow or a combination of cocurrent and countercurrent flow may also be implemented according to the teachings of the present invention.

Figure 2:
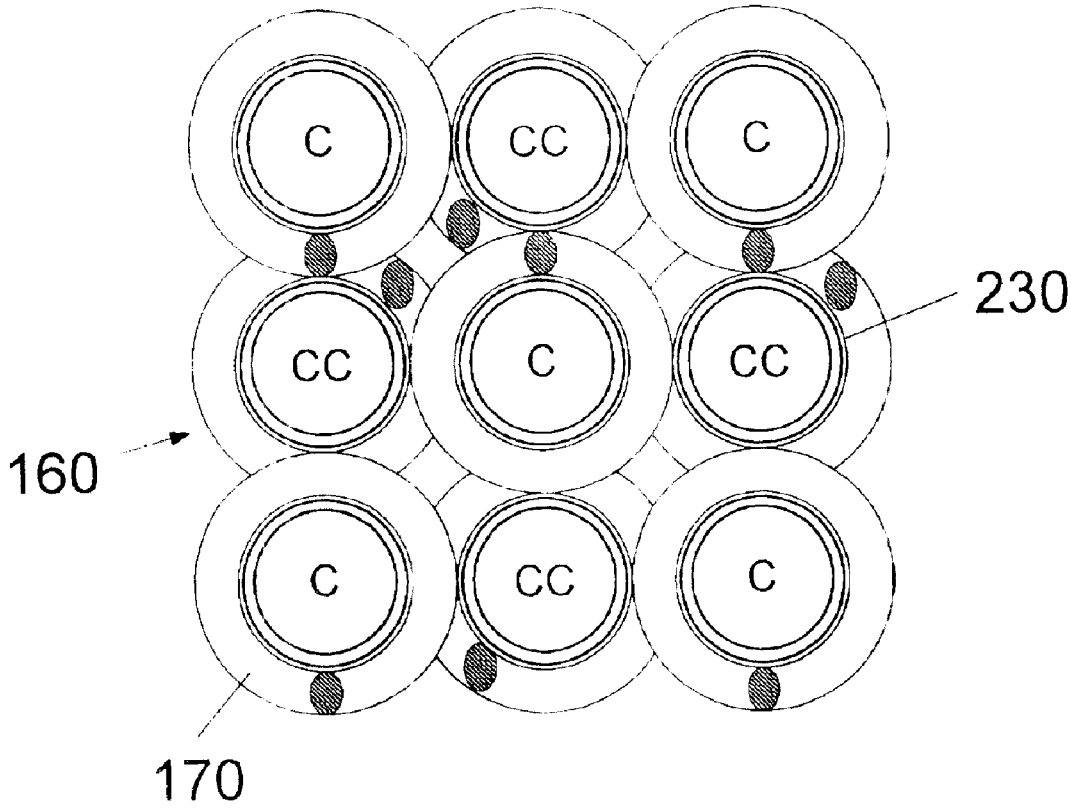
FIG. 2 is a cross-sectional view of the heat exchanger of the present invention according to a first embodiment wherein the coil wire thickness is substantially equal to the inter-tube spacing and the tubes are placed in an in-line pitch.

Turning now to FIG. 2, the novel support structure employed to support the tubes contained within tube bundle 160 is described. In a first embodiment as reflected by FIG. 2, coiled wires which have a diameter that is substantially equal to the space between the tubes comprising tube bundle 160 are used. The wire material is preferably comprised of erosion-resistant material such as stainless steel, titanium or other materials with similar metallurgical characteristics. In connection with the description herein, it will be understood by one of skill in the art that the term "wire" may encompass any or all of a wire, rod, strip or bar, all of which may be implemented in constructing the support structure of the present invention. As can be seen in FIG. 2, in the finished product, the wire material is wrapped around the tubes 230 to form coils that overlap with one another.

The coils structure is preferably constructed as follows. Coils 170 are prefabricated according to the specified diameter, tube pitch and coil pitch requirements. Coil pitch represents the axial distance along the tube length associated with one complete 360° turn around the tube. In a preferred embodiment the coil makes at least two complete turns around the length of the tube. Such prefabricated coils are generally available from coil manufacturers. Individual coils 170 are placed in a jig and adjacent coils are preferably fused together by welding. For example electrical arc welding may be used. According to the teachings of the present invention, coils 170 may be comprised of various wire cross-sections such as circular, square, elliptical, rectangular, or other suitable geometric shapes. FIG. 2 is an example of the use of circular cross-section for coils 170. It will be appreciated by one of skill in the art that in connection with the fabrication process, the coil outer diameter must not exceed the tube pitch plus one intertube space and further that the inside diameter of the coils 170 must have sufficient clearance to allow for insertion of tubes 170.

In the FIG. 2 embodiment of the present invention, tubes 230 are aligned with one another in horizontal rows and also in vertical rows thus comprising the known in-line arrangement for tubes. As will be understood by one of skill in the art, other tube positioning arrangements are also possible without departing from the scope or spirit of the teachings of the present invention.

A series of coils 170 are connected together by welding to form the support structure of the present invention. As shown in FIG. 2, the coil wire thickness is substantially equal to the space that would otherwise exist between the tubes 230. This results in an overlapping arrangement as between the coils forming the framework of the support structure. It is preferable in this embodiment for various portions of the support structure to alternate as between counterclockwise and clockwise wrappings (illustrated in FIG. 2 as "CC" and "C" respectively). For example, in FIG. 2, the coil at the top left corner has a clockwise wrap while all coils in contact with that coil have a counterclockwise wrap.

As can be seen in FIG. 2, it is preferable that in the in-line embodiment, all tubes are contained within the interior surface of a coil 170. In other words, no tubes are located between the outer peripheries of two or more coils 170. It will also be understood by one of skill in the art that the outer edge of tube bundle 160 will preferably be fitted with sealing strips, rings or bands which are fastened to tube bundle 160 and extend toward the inner surface of shell 150 in order to avoid flow bypassing.

According to the teachings of the present invention, tubes 230 are interposed into the interior of coils 170 but tubes 230 are not physically attached (e.g. by welding) to each other. This provides the advantage that it is easier to fabricate the exchanger as well as service the exchanger by replacing damaged tubes.

Figure 3:
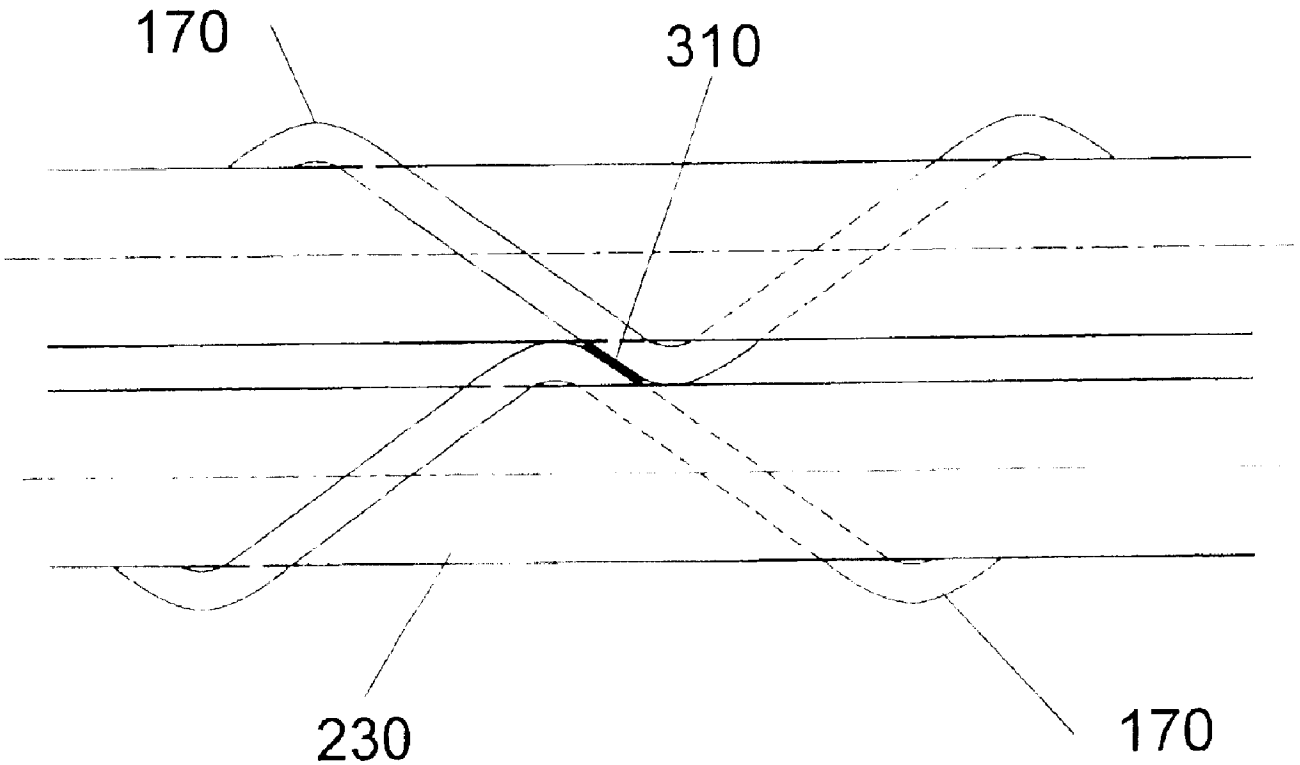
FIG. 3 is a close up view of tubes and the coil structure according to the first embodiment of the present invention as also illustrated by FIG. 2.

FIG. 3 is a close up side view of the tube support structure of the present invention including the tubes 230 and the coils 170. Colts 170 extend in the inter-tube space and coils 170 themselves overlap with one another when viewed from the axial direction as in FIG. 2. When viewed from the front as in FIG. 3, the coils 170 make contact with one another via weld 310. In FIG. 3, the top coil 170 is wound in a clockwise fashion when viewed from the right while the bottom coil 170 is wound in a counterclockwise fashion when viewed from the right.

Figure 4:
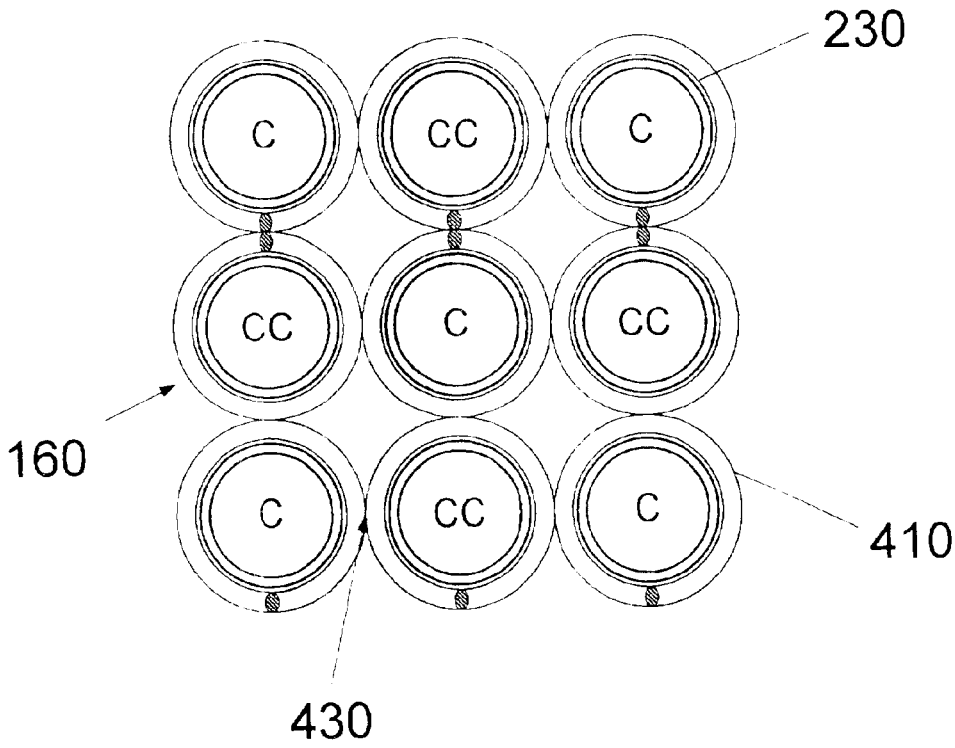
FIG. 4 is a cross-sectional view of the heat exchanger of the present invention according to a second embodiment wherein the coil wire thickness is substantially equal to one-half of the inter-tube spacing.

Turning now to FIG. 4, an axial view of the heat exchanger 100 of the present invention according to a second embodiment is illustrated. In this embodiment, the thickness of coils 410 is substantially equal to one-half of the inter-tube spacing size. As a result, in this configuration, rather than overlapping with one another, coils make point contact with one another, for example at point 430. It is preferable in this embodiment, as it is in the first embodiment, for the wrapping of coils to alternate as between clockwise and counterclockwise for adjacent coils.

As will be readily understood by one of skill in the art, the two embodiments provided, namely using coil thicknesses of approximately 100% of the inter-tube spacing and approximately 50% of the inter-tube spacing are not the exclusive possibilities. In fact, any coil thickness which is at least 50% but no more than approximately 100% of the inter-tube spacing amount may be used in connection with the teachings of the present invention.

Figure 5:
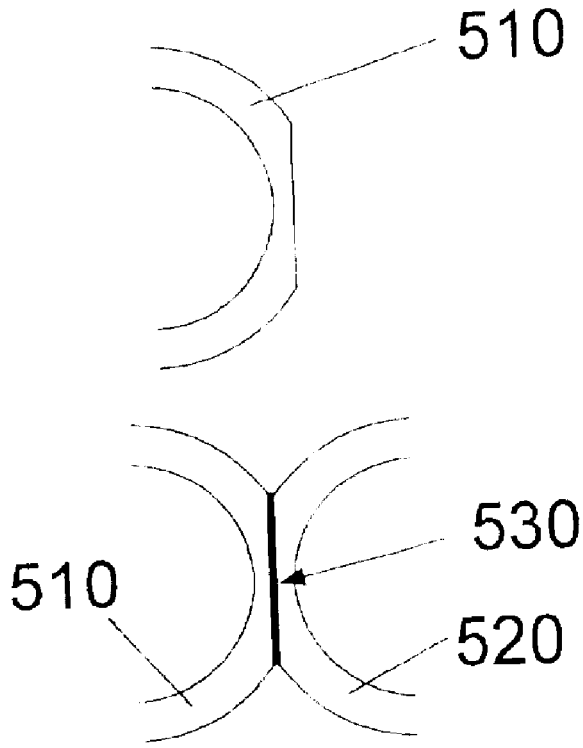
FIG. 5 is a cross-sectional view illustrating the weld between two coils within the support structure framework in the case of an embodiment of the present invention wherein the coil wire thickness is equal to any amount greater than one-half the inter-tube spacing and up to a full inter-tube spacing and the coils overlap with one another.

FIG. 5 illustrates the trimming requirements which may be undertaken in any embodiment of the present invention wherein the coil thickness is equal to any amount greater than one-half of the inter-tube spacing amount (i.e. any embodiment other than the above-described second embodiment). In such cases, it is possible to trim coil wire 510 so that it may make planar contact with its neighboring coil wire, for example in FIG. 5, coil wire 520. By employing trimming, and thus providing planar contact between coil wires 510 and 520, it is possible to create a larger contact area and thus provide a stronger weld. According to the teachings of the present invention, coil wires should be trimmed down to approximately one-half of the inter-tube space. For example, if the coil thickness of coil wires 510 and 520 were 70% of the inter-tube space, each of coil wires 510 and 520 should be trimmed down to approximately 50% of the inter-tube space at the contact point at weld 530.

Figure 6:
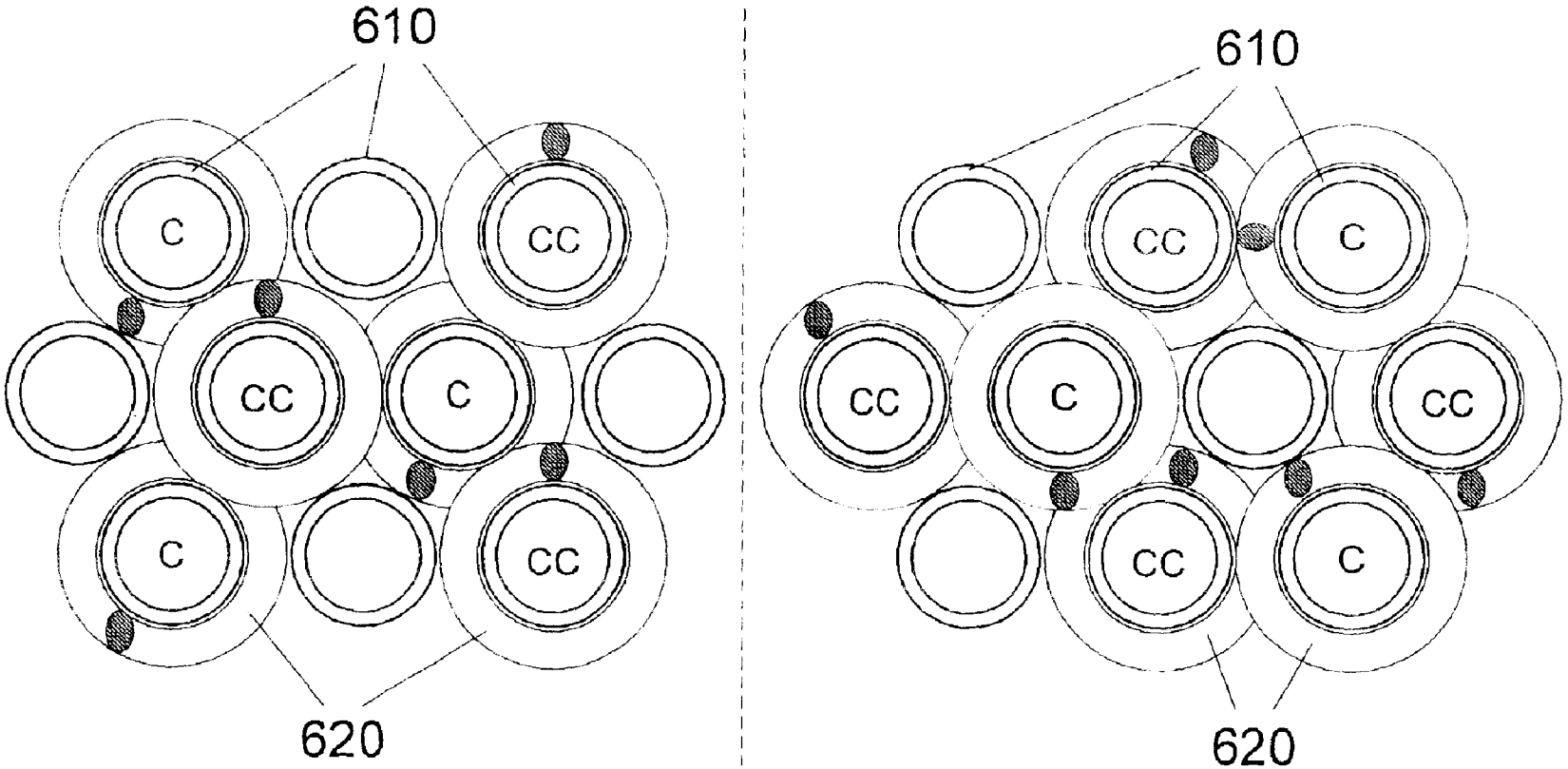
FIG. 6 is a cross-sectional view of the heat exchanger of the present invention according to a third embodiment wherein the coil wire thickness is equal to the inter-tube spacing and the tubes are placed in a triangular pitch.

FIG. 6 is an end view of a third embodiment of the present invention wherein the tubes 610 are arranged in triangular pitch. According to the teachings of the present invention, in this case, some tubes 610 will be contained within the interior of coils 620 and others will not. The tubes 610 that are not contained within the interior of individual coils 620 are nonetheless supported by the exterior of the coils 620 which are adjacent to the relevant tube 610. Again, in this embodiment, it is preferable that coils which are adjacent to one another be wound in opposite directions (i.e. clockwise adjacent to counterclockwise).

In FIG. 6, the coil thickness is equal to the inter-tube spacing which results in an overlap as between the adjacent coils when viewed from the end as in the FIG. 6 view. Alternatively, but not shown, coil thickness in the triangular pitch case can be anywhere from 50% of inter-tube spacing to 100% of inter-tube spacing. As discussed above, in the case of 50% of inter-tube spacing, the coils will make point contact and not overlap with one another.

The tubes on the left half of FIG. 6 represent the same tubes as is shown on the right half of FIG. 6. Thus, for example, the tube 610 at the upper left hand corner of the left side coil structure and tubes is the same tube as is shown in the upper left hand corner of the right side coil structure and tubes illustrated in FIG. 6. In a preferred embodiment of this invention, rather than extending from one tubesheet all the way to the other tubesheet, multiple sections of coil structures are interspersed along the length of the tubes 610 with gaps between such coil structures. However, it is possible for the coil structure to extend the full length of the tubes without gaps. In this case, it is preferable that the coil structure be produced such that individual segments with alternating designs are placed end to end to form a coil structure extending the full length of the tubes.

It is preferable that each successive coil structure along the tube alternate with respect to which tubes are contained within the interior of the coils and which tubes are not. Thus, for example, the tube at the upper left corner illustrated in the left side of FIG. 6 is contained within a coil 610 at one point during the length of the tube while further down the tube at the next successive coil structure segment (as shown on the right side of FIG. 6), that same tube is supported by the exterior surfaces of the adjacent coils. It is preferable to form each coil structure such that successive coil structures alternate with respect to which tubes are enclosed internally and which are not as described above.

It is preferable that in connection with the use of the heat exchanger of the present invention, a strainer of some form is employed at some point in the process line prior to reaching the heat exchanger. This is important in order to avoid any debris becoming trapped within the heat exchanger of the present invention either in a tube or on the shell side of the heat exchanger. If debris of a large enough size or of a large enough amount were to enter the heat exchanger of the present invention (or, in fact, any currently existing heat exchanger) fluid velocities can be reduced to the point of rendering the heat exchanger ineffective.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A heat exchanger comprising:

(a) a plurality of tubes having opposite ends and being spaced apart according to a predetermined inter-tube spacing amount, each said end being in contact with a tubesheet;

(b) a support structure for supporting said tubes, said support structure further comprising a plurality of support coils, said support coils comprising helically wound material wherein at least a portion of the length of each of said tubes is contained within the interior circumference of one said support coil wherein the diameter of the wire forming each said support coil is essentially equal to the predetermined inter-tube spacing wherein said support coils partially overlap with each other to share the inter-tube space between each of said tubes and each coil is wound in either a clockwise or counterclockwise orientation with coils containing adjacent tubes wrapped in an orientation that is different from the adjacent coil with adjacent support coils contact with one another being welded together.

2. The heat exchanger of claim 1 wherein said tubes are positioned in an in-line pitch orientation with respect to one another.

3. The heat exchanger of claim 1 wherein each coil is essentially the same longitudinal length as each of the tubes.

4. The heat exchanger of claim 1 wherein said each coil is comprised of a plurality of partial coils extending along a portion of each said tube and said partial coils along said tubes are intermittently positioned along the length of said tube with gaps present there between.

5. The heat exchanger of claim 1 wherein each coil is formed from wire with a circular cross section.

6. The heat exchanger of claim 1 wherein each coil is formed from wire with an elliptical cross section.

7. The heat exchanger of claim 1 which includes a first set of said tubes are contained within the interior circumferences of said support structure and a second set of said tubes are supported by at least one surface formed by the exterior of said support structure.

8. The heat exchanger of claim 7 wherein each coil is essentially the same longitudinal length as each of the tubes.

9. The heat exchanger of claim 7 wherein said each coil is comprised of a plurality of partial coils extending along a portion of each said tube and said partial coils along said tubes are intermittently positioned along the length of said tube with gaps present there between.

* * * * *